US011059557B2

(12) United States Patent
Barratt

(10) Patent No.: US 11,059,557 B2
(45) Date of Patent: Jul. 13, 2021

(54) MARINE OUTBOARD MOTOR WITH SHIFT MECHANISM

(71) Applicant: COX POWERTRAIN LIMITED, Shoreham-By-Sea (GB)

(72) Inventor: James Barratt, Shoreham-By-Sea (GB)

(73) Assignee: COX POWERTRAIN LIMITED, Shoreham-By-Sea (GB)

( * ) Notice: Subject to any disclaimer, the term of this patent is extended or adjusted under 35 U.S.C. 154(b) by 0 days.

(21) Appl. No.: 16/796,171

(22) Filed: Feb. 20, 2020

(65) Prior Publication Data

US 2020/0283113 A1 Sep. 10, 2020

(30) Foreign Application Priority Data

Mar. 7, 2019 (GB) ..... 1903092

(51) Int. Cl.

| | |
|---|---|
| ***B63H 20/14*** | (2006.01) |
| ***B63H 23/06*** | (2006.01) |
| ***B63H 23/30*** | (2006.01) |
| ***B63H 23/34*** | (2006.01) |

(52) U.S. Cl.

CPC ..... *B63H 20/14* (2013.01); *B63H 23/06* (2013.01); *B63H 23/30* (2013.01); *B63H 23/34* (2013.01)

(58) Field of Classification Search

CPC ..... B63H 20/14; B63H 23/08; B63H 23/30; B63H 23/34

See application file for complete search history.

(56) References Cited

U.S. PATENT DOCUMENTS

| | | | | |
|---|---|---|---|---|
| 4,861,295 | A | 8/1989 | McElroy, Jr. et al. | |
| 4,865,570 | A * | 9/1989 | Higby | B63H 21/28 440/86 |
| 6,217,400 | B1 * | 4/2001 | Natsume | B63H 20/20 440/75 |
| 7,291,048 | B1 | 11/2007 | Phillips et al. | |
| 9,174,715 | B1 | 11/2015 | Hanes et al. | |

OTHER PUBLICATIONS

Search Report & Written Opinion issued in Int'l Appl. No. PCT/GB2020/050519 (dated 2020).

* cited by examiner

*Primary Examiner* — Stephen P Avila
(74) *Attorney, Agent, or Firm* — Barnes & Thornburg LLP

(57) ABSTRACT

A marine outboard motor is provided with a gear casing, a propeller shaft rotatable within the gear casing about a propeller shaft axis, a drive shaft having a drive gear, a clutch mechanism for selectively engaging the drive gear with the propeller shaft and a shift mechanism configured to operate the clutch mechanism. The shift mechanism comprises a support shaft which is fixed relative to the gear casing and which extends along or parallel with the propeller shaft axis, a shift shuttle which is slidable along the support shaft and is connected to a clutch member of the clutch mechanism, a shift finger pivotally mounted on the support shaft, and a shift rod coupled to the shift finger by a releasable coupling. The shift finger is configured to move the shift shuttle along the support shaft to operate the clutch member.

16 Claims, 6 Drawing Sheets

MARINE OUTBOARD MOTOR WITH SHIFT MECHANISM

CROSS REFERENCE TO RELATED APPLICATIONS

This application claims priority to United Kingdom Patent Application No. 1903092.3, filed Mar. 7, 2019. The disclosure set forth in the referenced applications is incorporated herein by reference in its entirety.

TECHNICAL FIELD

The present invention relates to a marine outboard motor with a drive shaft, a clutch mechanism for selectively engaging the drive shaft with the propeller shaft and a shift mechanism for operating the clutch mechanism to selectively transfer drive from the drive shaft to the propeller shaft.

BACKGROUND

In order to propel a marine vessel, an outboard motor is often attached to the stern of the vessel. The outboard motor is generally formed of three sections: an upper powerhead including an internal combustion engine; a lower-section including a propeller shaft connected to the internal combustion engine via a drive shaft; and a middle section defining an exhaust gas flow path for transporting exhaust gases from the upper section to the lower section. In a conventional outboard motor, the drive shaft extends in a vertical direction and has a drive gear, such as a bevel gear, at its lower end which is selectively engaged with the propeller shaft by a clutch mechanism operated by a shift mechanism. The propeller shaft, the clutch mechanism, and the shift mechanism are normally housed in gearbox, or transmission casting, in the lower section of the motor.

Typically, the clutch mechanism has a forward gear, a reverse gear and a moveable clutch member, often in the form of a dog clutch or dog ring. The forward gear and the reverse gear are typically freely rotatable about the propeller shaft and are constantly meshed with opposite sides of the drive gear at the end of the drive shaft such that the forward gear and reverse gear are always driven to rotate in opposite directions by the drive shaft. The clutch member usually extends around the propeller shaft and is slidable along the axial direction of the propeller shaft by the shift mechanism but is rotatably fixed to the propeller shaft such that the clutch member and the propeller shaft rotate together. When the clutch member is moved axially along the propeller shaft by the shift mechanism to a forward position, the clutch member engages with the forward gear and the propeller shaft is driven in a forward direction by the meshing of the bevel gear, forward gear and the clutch member. When the dog clutch is moved axially in the opposite direction to a reverse position, the clutch member engages with the reverse gear and the propeller shaft is driven in a reverse direction.

Shift mechanisms for marine outboard motors typically include a shift shuttle or "slider" which is operated by a shift rod extending vertically through an access hole in an upper wall of the gearbox. The shift shuttle is usually mounted at the end of the propeller shaft and connected to the clutch member. The shift rod is usually engaged with the shift shuttle via a shift finger or "shift crank" which is fixed to the lower end of the shift rod and which rotates about the shift rod axis to transcribe a circular arc when the shift rod is rotated. In this manner, the shift finger is able to move the shift shuttle axially relative to the propeller shaft and thereby move the clutch member to the forward, neutral or reverse positions. While such shift mechanisms function well during operation, the shift finger must be fixed to the shift rod prior to insertion of the shift rod through the access hole in the upper wall of the gearbox during assembly otherwise it will be loose within the gearbox. Consequently, the access hole in the upper wall of the gearbox must be sized to accommodate the combined width of the shift rod and the shift finger. This results in a fairly large hole which can compromise the strength of the gearbox casting. Additionally, it can be difficult to align the shift shuttle and the shift finger with such an arrangement, causing delays in assembly.

The present invention seeks to provide an improved marine outboard motor which overcomes or mitigates one or more problems associated with the prior art.

SUMMARY OF THE INVENTION

According to a first aspect of the present invention, there is provided a marine outboard motor comprising: a gear casing; a propeller shaft rotatable within the gear casing about a propeller shaft axis; a drive shaft having a drive gear; a clutch mechanism for selectively engaging the drive gear with the propeller shaft, the clutch mechanism comprising a clutch member configured to selectively transfer drive from the drive shaft to the propeller shaft; and a shift mechanism housed in the gear casing and configured to operate the clutch mechanism, the shift mechanism comprising: a support shaft which is fixed relative to the gear casing and which extends along or parallel with the propeller shaft axis, a shift shuttle which is slidable along the support shaft and is connected to the clutch member; a shift finger which is pivotally mounted on the support shaft; and a shift rod extending through a wall of the gear casing and coupled to the shift finger by a releasable coupling such that the shift finger is pivotally fixed in relation to the shift rod about a shift rod axis, wherein the shift finger engages with the shift shuttle such that the shift shuttle is moved along the support shaft by the shift finger to operate the clutch member when the shift finger is rotated about the shift rod axis by the shift rod.

With this arrangement, the shift finger is not fixed to the shift rod but is provided as part of a sub-assembly including the shift shuttle and the support shaft and is supported in position within the gear casing by the support shaft. This differs from existing systems in which the shift shuttle runs in a housing and the shift finger is fixed to the shift rod. Due to the provision of the support shaft, the housing can be omitted, resulting in a shift mechanism with reduced diameter and mass. The shift mechanism can then be assembled as part of a prop shaft sub-assembly which is small enough to be fed through the inner races of the front bearings in the transmission, greatly simplifying assembly. Further, by arranging both of the shift finger and the shift shuttle on the support shaft, the shift finger and the shift shuttle can be correctly aligned prior to insertion into the gear casing. This avoids the difficult and time consuming assembly process of aligning and engaging the shift finger with the shift shuttle during insertion of a combined shift finger and shift rod which is typically required with many existing arrangements.

Additionally, since the shift finger is mounted on the support shaft and is not fixed to the shift rod, the access hole in the wall of the gear casing, through which the shift rod is inserted during assembly, only needs to be wide enough to accommodate the shift rod diameter, rather than wide enough to accommodate the combined width of the shift rod and the shift finger, as is required in existing arrangements. This reduced access hole size can result in an increase in the strength and rigidity of the gear casing. It can also reduce the amount of oil leakage out of the gear casing or the amount of water ingress into the gear casing through the access hole.

The shift rod may comprise a cavity within which part of the shift finger is received in order to releasably couple the shift finger and the shift rod. Preferably, the shift finger comprises a cavity within which the shift rod is removably received to couple the shift finger to the shift rod. The cavity may be a blind cavity or a through-hole.

The shift rod and the shift finger are releasably coupled by a releasable coupling. The shift finger is pivotally fixed in relation to the shift rod by the releasable coupling such that the shift finger and the shift rod rotate together about the shift rod axis.

The releasable coupling may comprise one or more non-rotationally symmetrical surfaces on an inner side wall of the opening and one or more corresponding non-rotationally symmetrical surfaces on the shift rod which engage with the one or more non-rotationally symmetrical surfaces on the inner side wall of the opening to prevent relative rotation. For example, the end of the shift rod and the opening may each have a triangular, or other polygonal, cross-section.

Preferably, the releasable coupling comprises a recess in one of the shift rod and the shift finger and a corresponding protrusion on the other of the shift rod and the shift finger, wherein the recess and the protrusion are configured such that relative rotation between the shift rod and the shift finger about the shift rod axis is prevented when the protrusion is received in the recess. For example, the shift rod may comprise a recess in its end surface which engages with a corresponding protrusion on the shift finger to prevent relative rotation between the shift rod and the shift finger about the shift rod axis. Where the shift finger comprises a cavity within which the shift rod is removably received, the protrusion on the shift finger may be provided within the cavity. The recess is open in a direction along the shift rod axis. Thus, the protrusion can be inserted into the recess when the shift rod is inserted into the gear casing after the shift finger has been assembled within the gear casing.

Preferably, the shift finger comprises a cavity within which the shift rod is removably received to couple the shift rod to the shift finger and the protrusion of the releasable coupling comprises a pin extending across the cavity. The pin may extend across the entire width of the opening in the shift finger.

Where the protrusion of the releasable coupling comprises a pin extending across the cavity, the recess preferably comprises a slot in the end surface of the shift rod in which the pin is received when the shift rod is received in the cavity of the shift finger. This can provide an extremely effective means of rotationally coupling the shift rod and the shift finger which is simple to manufacture and facilitates assembly.

Preferably, the support shaft is concentric with the propeller shaft. In such embodiments, the support shaft extends along the propeller shaft axis. This can help to minimise the weight and size of the shift assembly and of the gear casing. In other examples, the support shaft may extend along an axis which is offset from the propeller shaft axis. This may require the volume of the gear casing to be increased.

Preferably, the support shaft is secured directly to the gear casing. For example, the support shaft may be bolted to the gear casing.

Preferably, the support shaft is secured directly to the gear casing by a threaded connector, such as a bolt, extending through the gear casing. This can facilitate assembly of the shift mechanism in the gear casing by enabling the support shaft to be easily secured from outside the gear casing. The support shaft may be further retained by a circlip.

Preferably the shift finger extends through an aperture in the shift shuttle. The aperture may be formed from a cross drilling through the shift shuttle. The shift finger may engage with the shift shuttle via the aperture. This provides a simple connection.

Preferably, the clutch mechanism further comprises at least one gear which is engaged with the drive gear and configured to rotate freely around the propeller shaft.

Preferably, the clutch member is rotatably fixed to the propeller shaft and is moveable along the propeller shaft axis relative to the propeller shaft and the shift shuttle is configured to move the clutch member along the propeller shaft axis to selectively engage the clutch member with the at least one gear to transfer drive from the drive shaft to the propeller shaft.

The at least one gear may comprise a forward gear which is engaged with the drive gear to rotate in a forward direction. When the clutch member is engaged with the forward gear, drive is transferred from the drive shaft to the propeller shaft in the forward direction. The at least one gear may comprise a reverse gear which is engaged with the drive gear to rotate in a reverse direction. When the clutch member is engaged with the reverse gear, drive is transferred from the drive shaft to the propeller shaft in the reverse direction.

Preferably, the at least one gear comprises a forward gear which is engaged with the drive gear to rotate in a forward direction and a reverse gear which is engaged with the drive gear to rotate in a reverse direction.

Preferably, the clutch member is disposed between the forward and reverse gears and is moveable by the shift mechanism along the propeller shaft axis between a forward position, in which the clutch member is engaged with the forward gear, and a reverse position, in which the clutch member is engaged with the reverse gear. The clutch member may be moveable to a neutral position in which it is not engaged with either of the forward or reverse gears and thus no drive is transferred from the drive shaft to the propeller shaft.

The clutch member may be mounted on one side of the propeller shaft. Preferably, the clutch member extends around the propeller shaft.

The clutch member preferably comprises a dog ring. The dog ring may comprise a plurality of engagement recesses and/or protrusions which fit against corresponding engagement protrusions and/or recesses on the at least one gear when the dog ring is selectively engaged with the at least one gear.

The marine outboard motor may comprise an internal combustion engine configured to drive the drive shaft. The internal combustion engine may comprise an engine block and at least one cylinder. The engine block may comprise a single cylinder. Preferably, the engine block comprises a plurality of cylinders.

As used herein, the term "engine block" refers to a solid structure in which at least one cylinder of the engine is provided. The term may refer to the combination of a cylinder block with a cylinder head and crankcase, or to the cylinder block only. The engine block may be formed from a single engine block casting. The engine block may be formed from a plurality of separate engine block castings which are connected together, for example using bolts.

The engine block may comprise a single cylinder bank.

The engine block may comprise a first cylinder bank and a second cylinder bank. The first and second cylinder banks may be arranged in a V configuration.

The engine block may comprise three cylinder banks. The three cylinder banks may be arranged in a broad arrow configuration. The engine block may comprise four cylinder banks. The four cylinder banks may be arranged in a W or double-V configuration.

The internal combustion engine may be arranged in any suitable orientation. Preferably, the internal combustion engine is a vertical axis internal combustion engine. In such an engine, the internal combustion engine comprises a crankshaft which is mounted vertically in the engine. The crankshaft may be connected to the drive shaft directly or indirectly via one or more intermediate components.

The internal combustion engine may be a petrol engine. Preferably, the internal combustion engine is a diesel engine. The internal combustion engine may be a turbocharged diesel engine.

According to a second aspect of the present invention, there is provided a marine vessel comprising the marine outboard motor of the first aspect.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Further features and advantages of the present invention will be further described below, by way of example only, with reference to the accompanying drawings in which.

DETAILED DESCRIPTION

Figure 1:
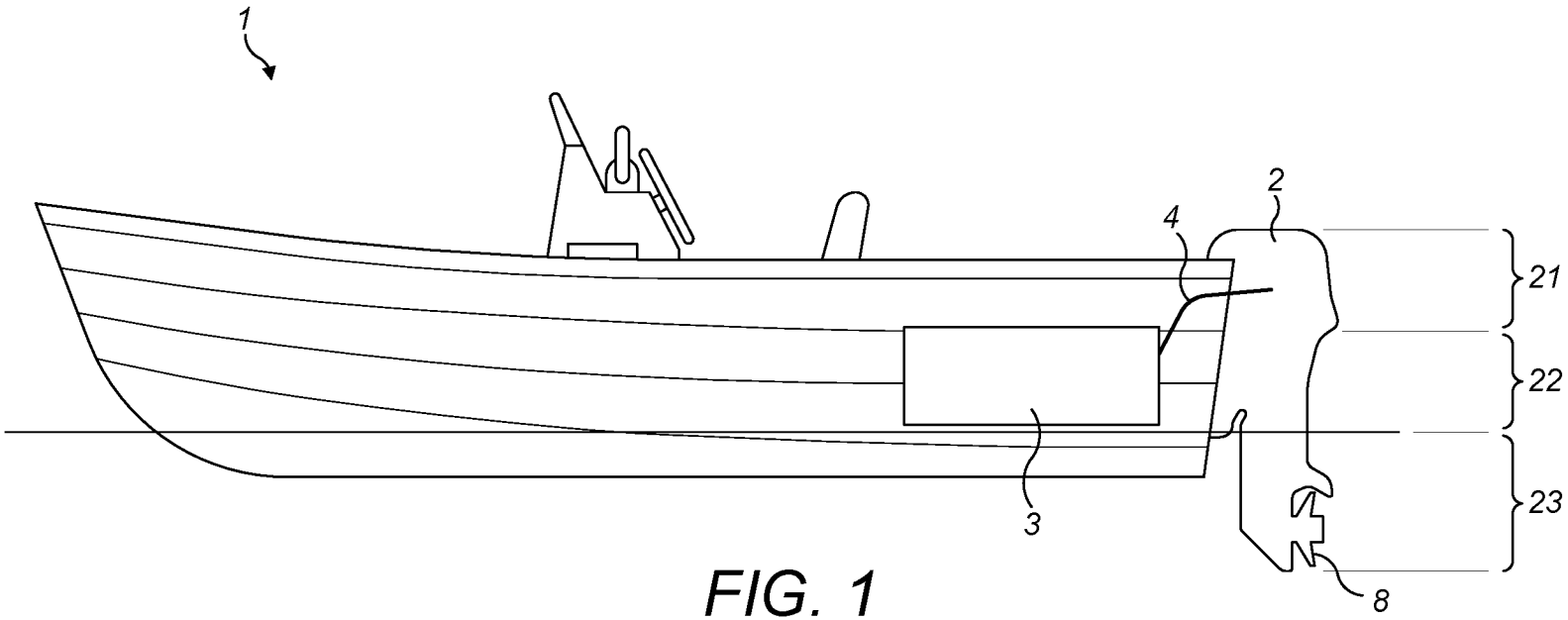
FIG. 1 is a schematic side view of a light marine vessel provided with a marine outboard motor.

FIG. 1 shows a schematic side view of a marine vessel 1 with a marine outboard motor 2. The marine vessel 1 may be any kind of vessel suitable for use with a marine outboard motor, such as a tender or a scuba-diving boat. The marine outboard motor 2 shown in FIG. 1 is attached to the stern of the vessel 1. The marine outboard motor 2 is connected to a fuel tank 3, usually received within the hull of the marine vessel 1. Fuel from the reservoir or tank 3 is provided to the marine outboard motor 2 via a fuel line 4. Fuel line 4 may be a representation for a collective arrangement of one or more filters, low pressure pumps and separator tanks (for preventing water from entering the marine outboard motor 2) arranged between the fuel tank 3 and the marine outboard motor 2.

As will be described in more detail below, the marine outboard motor 2 is generally divided into three sections, an upper-section 21, a mid-section 22, and a lower-section 23. The mid-section 22 and lower-section 23 are often collectively known as the leg section, and the leg houses the exhaust system. A propeller 8 is rotatably arranged on a propeller shaft 29 at the lower-section 23, also known as the gearbox, of the marine outboard motor 2. Of course, in operation, the propeller 8 is at least partly submerged in water and may be operated at varying rotational speeds to propel the marine vessel 1.

Typically, the marine outboard motor 2 is pivotally connected to the stern of the marine vessel 1 by means of a pivot pin. Pivotal movement about the pivot pin enables the operator to tilt and trim the marine outboard motor 2 about a horizontal axis in a manner known in the art. Further, as is well known in the art, the marine outboard motor 2 is also pivotally mounted to the stern of the marine vessel 1 so as to be able to pivot, about a generally upright axis, to steer the marine vessel 1.

Tilting is a movement that raises the marine outboard motor 2 far enough so that the entire marine outboard motor 2 is able to be raised completely out of the water. Tilting the marine outboard motor 2 may be performed with the marine outboard motor 2 turned off or in neutral. However, in some instances, the marine outboard motor 2 may be configured to allow limited running of the marine outboard motor 2 in the tilt range so as to enable operation in shallow waters. Marine engine assemblies are therefore predominantly operated with a longitudinal axis of the leg in a substantially vertical direction. As such, a crankshaft of an engine of the marine outboard motor 2 which is substantially parallel to a longitudinal axis of the leg of the marine outboard motor 2 will be generally oriented in a vertical orientation during normal operation of the marine outboard motor 2, but may also be oriented in a non-vertical direction under certain operating conditions, in particular when operated on a vessel in shallow water. A crankshaft of a marine outboard motor 2 which is oriented substantially parallel to a longitudinal axis of the leg of the engine assembly can also be termed a vertical crankshaft arrangement. A crankshaft of a marine outboard motor 2 which is oriented substantially perpendicular to a longitudinal axis of the leg of the engine assembly can also be termed a horizontal crankshaft arrangement.

Figure 2A:
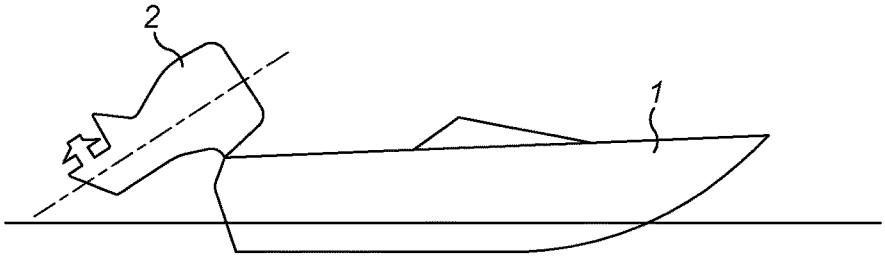
FIG. 2A shows a schematic representation of a marine outboard motor in its tilted position.

As mentioned previously, to work properly, the lower-section 23 of the marine outboard motor 2 needs to extend into the water. In extremely shallow waters, however, or when launching a vessel off a trailer, the lower-section 23 of the marine outboard motor 2 could drag on the seabed or boat ramp if in the tilted-down position. Tilting the marine outboard motor 2 into its tilted-up position, such as the position shown in FIG. 2A, prevents such damage to the lower-section 23 and the propeller 8.

Figure 2B:
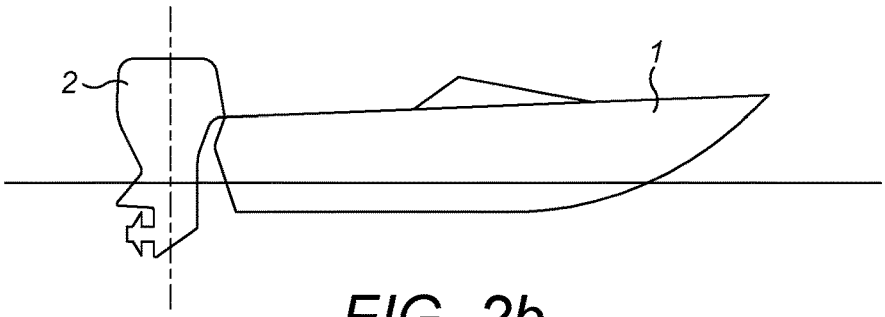
FIGS. 2B to 2D show various trimming positions of the marine outboard motor and the corresponding orientation of the marine vessel within a body of water.
Figure 2C:
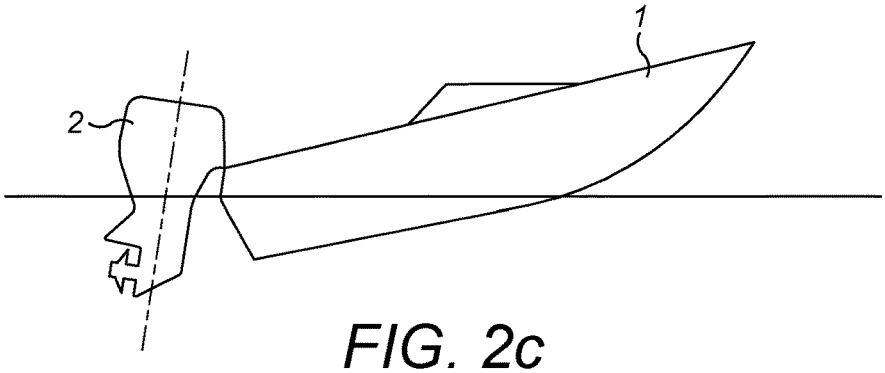
Figure 2D:
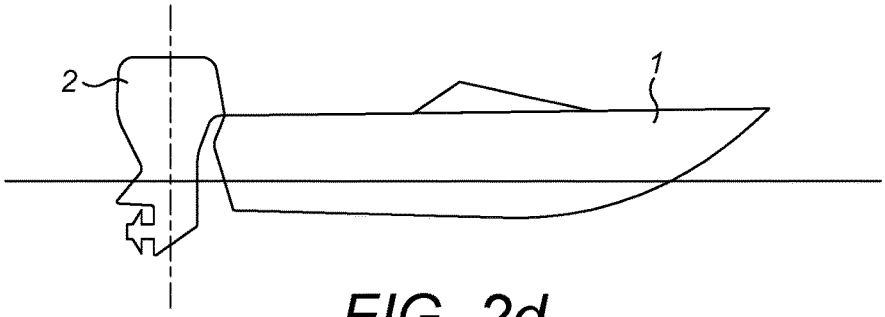

By contrast, trimming is the mechanism that moves the marine outboard motor 2 over a smaller range from a fully-down position to a few degrees upwards, as shown in the three examples of FIGS. 2B to 2D. Trimming helps to direct the thrust of the propeller 8 in a direction that will provide the best combination of fuel efficiency, acceleration and high speed operation of the marine vessel 1.

When the vessel 1 is on a plane (i.e. when the weight of the vessel 1 is predominantly supported by hydrodynamic lift, rather than hydrostatic lift), a bow-up configuration results in less drag, greater stability and efficiency. This is generally the case when the keel line of the boat or marine vessel 1 is up about three to five degrees, such as shown in FIG. 2B for example.

Too much trim-out puts the bow of the vessel 1 too high in the water, such as the position shown in FIG. 2C. Performance and economy, in this configuration, are decreased because the hull of the vessel 1 is pushing the water and the result is more air drag. Excessive trimming-out can also cause the propeller to ventilate, resulting in further reduced performance. In even more severe cases, the vessel 1 may hop in the water, which could throw the operator and passengers overboard.

Trimming-in will cause the bow of the vessel 1 to be down, which will help accelerate from a standing start. Too much trim-in, shown in FIG. 2D, causes the vessel 1 to "plough" through the water, decreasing fuel economy and making it hard to increase speed. At high speeds, trimming-in may even result in instability of the vessel 1.

Figure 3:
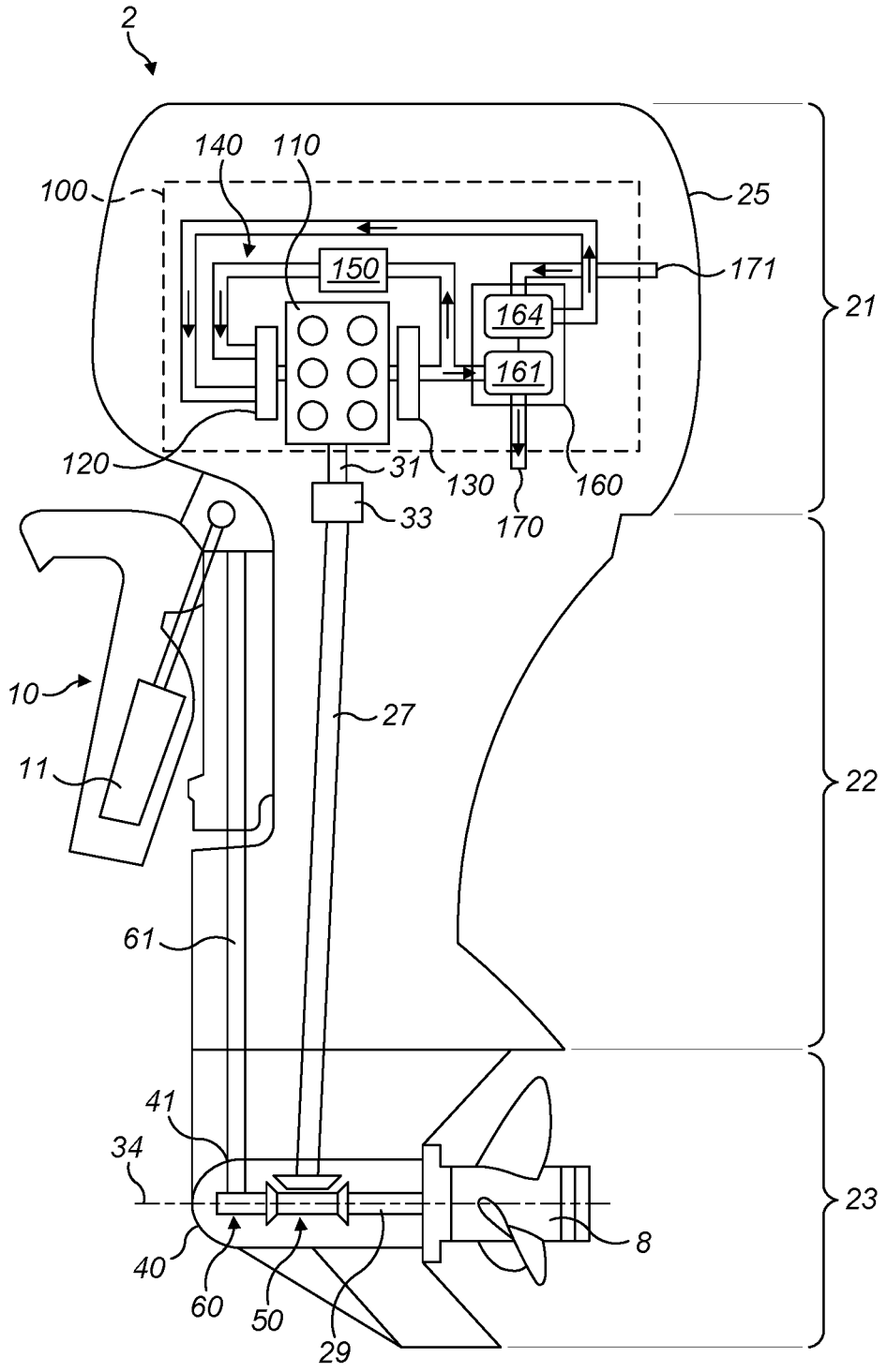
FIG. 3 shows a schematic cross-section of a marine outboard motor according to the present invention.

Turning to FIG. 3, there is shown a schematic cross-section of an outboard motor 2 according to an embodiment of the present invention. The outboard motor 2 comprises a tilt and trim mechanism 10 for performing the aforementioned tilting and trimming operations. In this embodiment, the tilt and trim mechanism 10 includes a hydraulic actuator 11 that can be operated to tilt and trim the outboard motor 2 via an electric control system. Alternatively, it is also feasible to provide a manual tilt and trim mechanism, in which the operator pivots the outboard motor 2 by hand rather than using a hydraulic actuator.

As mentioned above, the outboard motor 2 is generally divided into three sections. An upper-section 21, also known as the powerhead, includes an internal combustion engine 100 for powering the marine vessel 1. A cowling 25 is disposed around the engine 100. Adjacent to, and extending below, the upper-section 21 or powerhead, there is provided a mid-section 22 and a lower section 23. The lower-section 23 extends adjacent to and below the mid-section 22, and the mid-section 22 connects the upper-section 21 to the lower-section 23. The mid-section 22 houses a drive shaft 27 which extends between the combustion engine 100 and the propeller shaft 29 and is connected to a crankshaft 31 of the combustion engine via a floating connector 33 (e.g. a splined connection). The propeller shaft 29 is supported for rotation about a generally horizontal propeller shaft axis 34. At the lower end of the drive shaft 27, a gear box/transmission is provided that supplies the rotational energy of the drive shaft 27 to the propeller 8 in a horizontal direction. In more detail, the bottom end of the drive shaft 27 is rotationally connectable to the propeller shaft 29 of the propeller 8 by a clutch mechanism 50 which is operated by a shift mechanism 60, as discussed below in relation to FIGS. 4 to 6. The clutch mechanism 50 and the shift mechanism 60 are housed in a gear casing 40 at the lower end of the lower section 23. In this example, the gear casing has a torpedo shape. The shift mechanism 60 includes a shift rod 61 which extends vertically through the outboard motor 2 and through an access hole 41 in the upper wall 42 of the gear casing 40. The shift rod 61 is rotated by a shift actuator (not shown) located in the powerhead in order to operate the clutch mechanism 50. The mid-section 22 and lower-section 23 form an exhaust system, which defines an exhaust gas flow path for transporting exhaust gases from an exhaust gas outlet 170 of the internal combustion engine 100 and out of the outboard motor 2.

As shown schematically in FIG. 3, the internal combustion engine 100 includes an engine block 110, an air intake manifold 120 for delivering a flow of air to the cylinders in the engine block, and an exhaust manifold 130 configured to direct a flow of exhaust gas from the cylinders. In this example, the engine 100 further includes an optional exhaust gas recirculation (EGR) system 140 configured to recirculate a portion of the flow of exhaust gas from the exhaust manifold 130 to the air intake manifold 120. The EGR system includes a heat exchanger 150, or "EGR cooler", for cooling recirculated exhaust gas. The internal combustion engine 100 is turbocharged and so further includes a turbocharger 160 connected to the exhaust manifold 130 and to the air intake manifold 120. In use, exhaust gases are expelled from each cylinder in the engine block 110 and are directed away from the engine block 110 by the exhaust manifold 130. Where the engine includes an EGR system 140, a portion of the exhaust gases are diverted to the heat exchanger 150. The remaining exhaust gases are delivered from the exhaust manifold 130 to a turbine housing 161 of the turbocharger 160 where they are directed through the turbine before exiting the turbocharger 160 and the engine 100 via the engine exhaust outlet 170. The compressor housing 164 of the turbocharger, which is driven by the spinning turbine, draws in ambient air through an air intake 171 and delivers a flow of pressurised intake air to the air intake manifold 120. The engine 100 also includes an engine lubrication fluid circuit, to lubricate moving components in the engine block, and a turbocharger lubrication system (not shown in FIG. 3).

Figure 4:
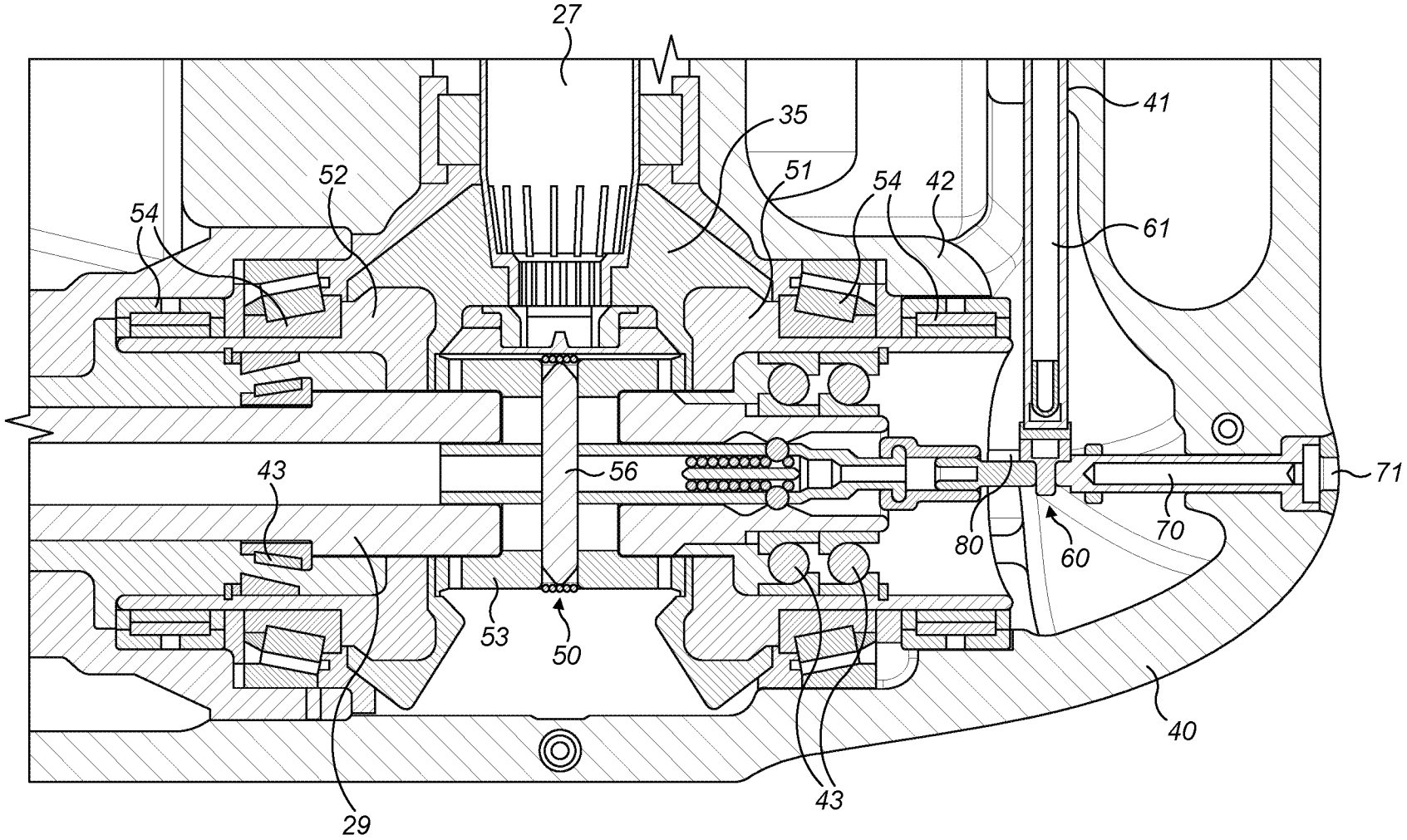
FIG. 4 shows an enlarged cross-sectional view of the gear casing of the marine outboard motor of FIG. 3.
Figure 5:
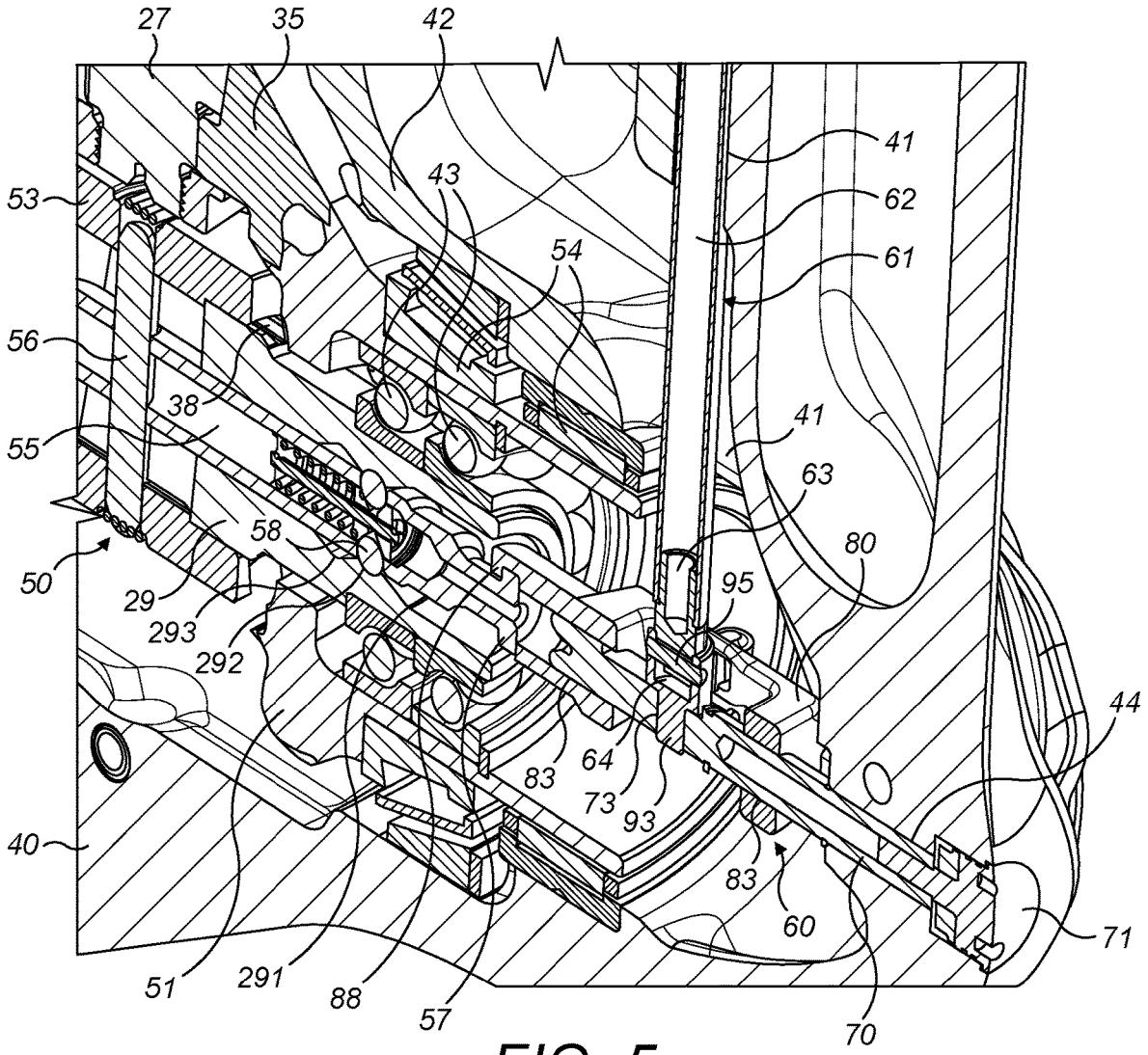
FIG. 5 shows a perspective cross-sectional view of a front part of the gear casing of FIG. 4 showing the shift mechanism and the clutch mechanism.
Figure 6:
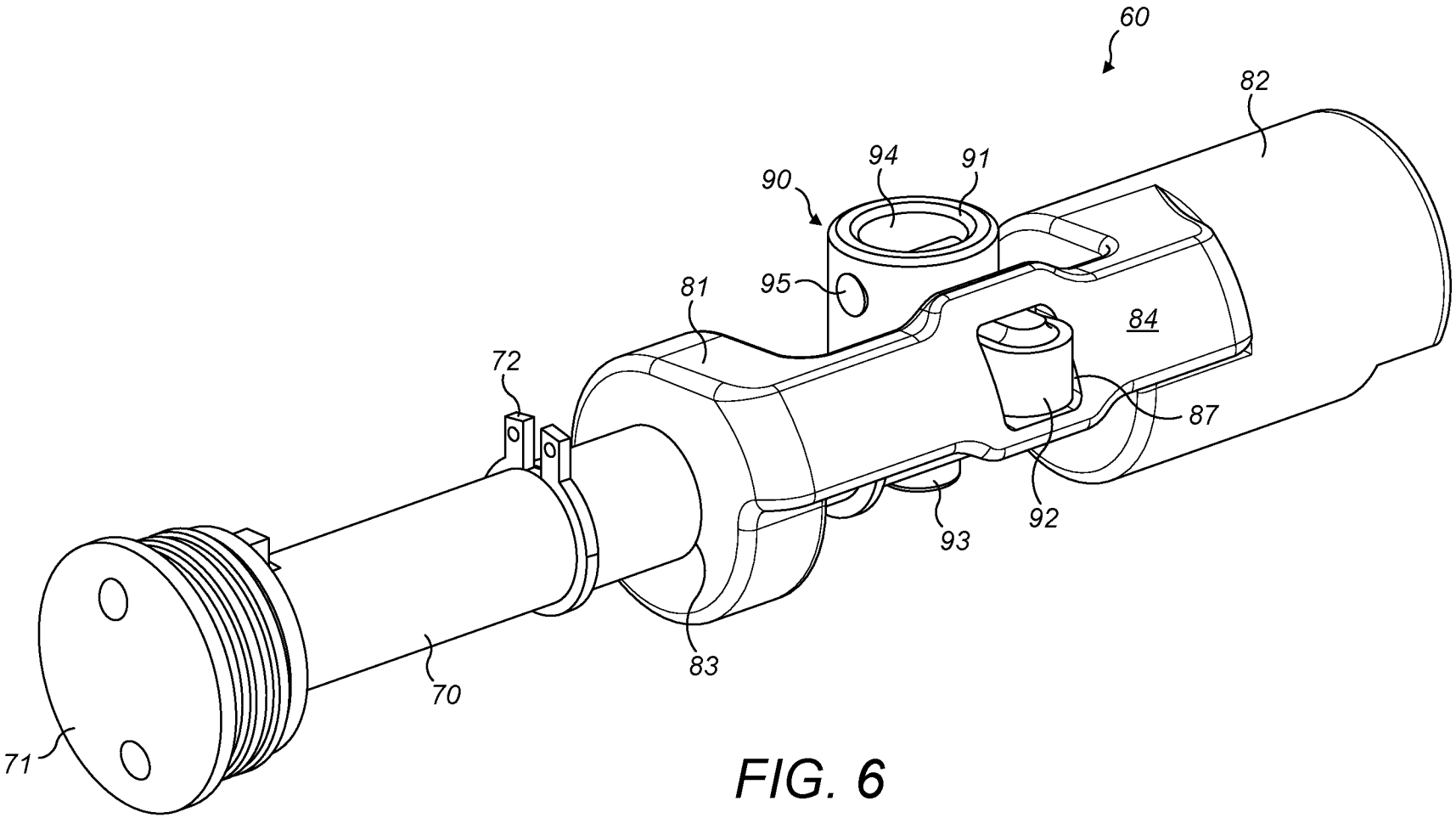
FIG. 6 shows a perspective view of the shift mechanism of FIG. 5.

As shown in FIGS. 4 to 6, the gear casing 40 houses a clutch mechanism 50 and a shift mechanism 60 by which the drive shaft 27 is connectable to the propeller shaft 29. The clutch mechanism 50 includes a forward gear 51, a reverse gear 52 and a moveable clutch member in the form of a dog clutch or dog ring 53. The forward gear 51 and the reverse gear 52 are supported on bearings 54 positioned between their respective outer surfaces and the inner surface of the wall 42 of the gear casing 40 such that the forward and reverse gears 51 and 52 are freely rotatable within the gear casing 40. The forward and reverse gears 51 and 52 are constantly meshed with opposite sides of a drive gear 35 fixed at the lower end of the drive shaft 27 such that the forward gear 51 and reverse gear 52 are always driven to rotate in opposite directions by the drive shaft 27. The clutch member 53 extends around the propeller shaft 27 and is slidable on the surface of the propeller shaft 29 along the propeller shaft axis 34 but is rotatably fixed to the propeller shaft 29 so that the clutch member 53 and the propeller shaft 29 rotate together about the propeller shaft axis 34. In this example, the clutch member 53 is connected to the propeller shaft 29 via a plurality of splines 38 on the propeller shaft. The propeller shaft 29 is rotatably supported within the gear casing 40 on bearings 43 positioned between the outer surface of the propeller shaft 29 and the inner surfaces of the forward and reverse gears 51 and 52. Thus, the forward and reverse gears 51 and 52 freely rotate about the propeller shaft 29. The clutch mechanism 50 further includes a clutch actuating shaft 55 which extends along the propeller shaft axis 34 within the clutch member 53 and the propeller shaft 29. The clutch actuating shaft 55 is locked for rotation with the clutch member 53 by a clutch pin 56 which extends through a milled out section in the propeller shaft 29, through the clutch actuating shaft 55 and into the clutch member 53. Thus, the clutch actuating shaft 55 rotates with the propeller shaft 29 and the clutch member 53 about the propeller shaft axis 34.

The shift mechanism 60 is housed in the gear casing 40 and is configured to operate the clutch mechanism 50. The shift mechanism 60 includes a shift rod 61, a support shaft 70, a shift shuttle 80, and a shift finger, or "shift crank", 90.

The shift rod 61 comprises a hollow circular rod 62, which extends vertically along a shift rod axis 65 and through an access hole 41 in the upper wall 42 of the gear casing 40, and has a coupling plug 63 which is fixed at its lower end. The coupling plug 63 has a slot 64 in its end surface.

The support shaft 70 is concentric with the propeller shaft 29 and is supported at its front end within a hole 44 extending through the nose of the gear casing 40. The support shaft 70 is secured directly to the nose of the gear casing 40 by a bolt 71 extending into the hole 44 from the outside of the gear casing 40 and by a circlip 72 against the inside wall of the gear casing 40.

The shift shuttle 80 has a front end 81 and a rear end 82 which each extend around the support shaft 70 and have an aperture 83 through which the support shaft 70 extends. The apertures 83 locate the shift shuttle 80 on the support shaft 70 and allow the shift shuttle 80 to slide along the support shaft along the propeller shaft axis 34. The front end 81 and the rear end 82 of the shift shuttle 80 are joined by an elongate central portion 84 which extends parallel to and laterally offset from the support shaft 70. The rear end 82 of the shift shuttle 80 has a hooked portion 88 which extends over a flange 57 on the front end of the clutch actuating shaft 55. The hooked portion 88 allows the shift shuttle 80 to push and pull the clutch actuating shaft 55 along the propeller shaft axis 34 while allowing the clutch actuating shaft 55 to rotate relative to the rotationally static shift shuttle 80. The front end of the clutch actuating shaft 55 comprises a pair of spring-loaded ball bearings 58 located rearward of the flange 57. The ball bearings 58 are sprung outward to locate in one of a series of detents 291-293 on the inner surface of the propeller shaft 29 to assist in the correct positioning of the clutch actuating shaft 55 along the propeller shaft axis 34. The detents comprise a forward detent 291, a neutral detent 292 and a reverse detent 293. In the position shown in FIG. 5, the spring-loaded ball bearings 58 are located in the neutral detent 292 and the clutch member 53 is in the neutral position between the forward and reverse gears 51 and 52.

The shift finger 90 has a main body 91 which is concentric with the shift rod 61 and has a crank portion 92 which extends laterally from the main body 91. The main body 91 rests against the top surface of the support shaft 70 and has a narrow lower portion 93 which is rotatably received in a vertical hole 73 in the support shaft 70. In this manner, the main body 91 is freely rotatable relative to the support shaft 70 but is otherwise retained in position relative to the support shaft 70 and the gear casing 40. The main body 91 comprises a cavity 94 which is open towards the shift rod along the shift rod axis and has a pin 95 extending across the width of the cavity 94. When the lower end of the coupling plug 63 is received in the cavity 94, the pin 95 is received in the slot 64 defined in the end surface of the shift rod 61. Together, the pin 95 and the slot 64 form a releasable coupling between the shift rod 61 and the shift finger 90. In this manner, the shift rod 61 is releasably coupled to the shift finger 90 such that the shift finger 90 is pivotally fixed in relation to the shift rod 61 about the shift rod axis 65. The crank portion 92 extends through an aperture 87 in the central portion 84 of the shift shuttle 80 to engage the shift finger 90 with the shift shuttle 80.

During assembly of the shift mechanism 60, the support shaft 70, shift shuttle 80 and shift finger 90 are inserted into the gear casing 40 as a sub-assembly, broadly as shown in FIG. 6 but minus the bolt 71. Due to the compact nature of this sub-assembly, these components can be fed through the inner races of the front bearings 43 in the transmission. The support shaft 70 is then inserted into the hole 41 in the nose of the gear casing 40 and is fixed in position by securing the bolt 71 in the front of the nose of the gear casing 40. The bolt 71 prevents axial movement of the support shaft 70 in a rearward direction and the circlip 72 prevents axial movement of the support shaft 70 in a forward direction. Once the support shaft 70 is secured in position, the cavity 94 should be located beneath the access hole 41 in the roof of the casing 40 and broadly aligned with the shift rod axis 65. The shift rod 61 is the inserted through the access hole 41 to removably locate the coupling plug 63 in the cavity 94 and to locate the pin 95 in the slot 64 at the lower end of the shift rod 61. Since the shift finger 90 is mounted on the support shaft 70 and is not fixed to the shift rod 61, the access hole 41 in the wall of the gear casing 40 only needs to be wide enough to accommodate the diameter of the shift rod 61. This reduces the necessary size of the access hole 41 relative to existing arrangements in which the shift finger 90 is fixed to and inserted with the shift rod 61. This can result in an increase in the strength and rigidity of the gear casing 40.

During operation, the clutch member 53 is moveable by the shift mechanism between a forward position, a neutral position, and a reverse position. In the neutral position, as shown in FIG. 5, the clutch member 53 is spaced from both the forward gear 51 and the reverse gear 52 and, therefore, no rotation is transferred from the drive shaft 27 to the propeller shaft 29. When the shift rod 61 is rotated clockwise, the shift shuttle 80 is moved along the support shaft 70 in a forward direction by the shift finger 90 to pull the clutch actuating shaft 55 and the clutch member 53 along the propeller shaft axis 34 towards the forward gear 51 and thereby mesh complementary engaging protrusions (not shown) on the clutch member 53 and the opposed face of the forward gear 51 to fix the clutch member 53 for rotation with the forward gear 51. As the clutch member 53 is fixed for rotation with the propeller shaft 29 and the forward gear 51 is meshed with the drive gear 35 for rotation in a forward direction, meshing of the clutch member 53 with the forward gear 51 causes the propeller shaft 29 to be driven in the forward direction. The shifting of the clutch member 53 into the forward position is assisted by the ball bearings 58, which locate in the forward detent 291 when the clutch member 53 is in the forward position. The clutch member 53 can be moved back to the neutral position by rotation of the shift rod 61 in the opposite direction. When the shift rod 61 is rotated in the clockwise direction from the neutral position shown in FIG. 5, the shift shuttle 80 is moved along the support shaft 70 in a rearward direction by the shift finger 90 to push the clutch member 53 along the propeller shaft axis 34 towards the reverse gear 52 and against the action of the sprung ball bearings 58, and thereby mesh complementary engaging protrusions (not shown) on the clutch member 53 and the opposed face of the reverse gear 52 to fix the clutch member 53 for rotation with the reverse gear 52. As the clutch member 53 is fixed for rotation with the propeller shaft 29 and the reverse gear 52 is meshed with the drive gear 35 for rotation in a reverse direction, meshing of the clutch member 53 with the reverse gear 52 causes the propeller shaft 29 to be driven in the reverse direction.

Although the invention has been described above with reference to one or more preferred embodiments, it will be appreciated that various changes or modifications may be made without departing from the scope of the invention as defined in the appended claims.

The invention claimed is:

1. A marine outboard motor comprising:

a gear casing;

a propeller shaft rotatable within the gear casing about a propeller shaft axis;

a drive shaft having a drive gear;

a clutch mechanism for selectively engaging the drive gear with the propeller shaft, the clutch mechanism comprising a clutch member configured to selectively transfer drive from the drive shaft to the propeller shaft; and a shift mechanism housed in the gear casing and configured to operate the clutch mechanism, the shift mechanism comprising:

a support shaft which is fixed relative to the gear casing and which extends along or parallel with the propeller shaft axis, a shift shuttle which is slidable along the support shaft and is connected to the clutch member;

a shift finger which is pivotally mounted on the support shaft; and a shift rod extending through a wall of the gear casing and coupled to the shift finger by a releasable coupling such that the shift finger is pivotally fixed in relation to the shift rod about a shift rod axis, wherein the shift finger engages with the shift shuttle such that the shift shuttle is moved along the support shaft by the shift finger to operate the clutch member when the shift finger is rotated about the shift rod axis by the shift rod.

2. The marine outboard motor of claim 1, wherein the shift finger comprises a cavity within which the shift rod is removably received to couple the shift rod to the shift finger.

3. The marine outboard motor of claim 1, wherein the releasable coupling comprises a recess in one of the shift rod and the shift finger and a corresponding protrusion on the other of the shift rod and the shift finger, wherein the recess is open in a direction along the shift rod axis, and wherein the recess and the protrusion are configured to prevent relative rotation between the shift rod and the shift finger about the shift rod axis when the protrusion is received in the recess.

4. The marine outboard motor of claim 3, wherein the shift finger comprises a cavity within which the shift rod is removably received to couple the shift rod to the shift finger, wherein the protrusion of the releasable coupling comprises a pin extending across the cavity.

5. The marine outboard motor of claim 4, wherein the recess comprises a slot in the end surface of the shift rod in which the pin is received when the shift rod is received in the cavity of the shift finger.

6. The marine outboard motor of claim 1, wherein the support shaft is concentric with the propeller shaft.

7. The marine outboard motor of claim 1, wherein the support shaft is secured directly to the gear casing.

8. The marine outboard motor of claim 7, wherein the support shaft is secured directly to the gear casing by a threaded connector extending through the gear casing.

9. The marine outboard motor of claim 1, wherein the shift finger extends through an aperture in the shift shuttle.

10. The marine outboard motor of claim 1, wherein the clutch mechanism further comprises at least one gear which is engaged with the drive gear and configured to rotate freely around the propeller shaft.

11. The marine outboard motor of claim 10, wherein the clutch member is rotatably fixed to the propeller shaft and is moveable along the propeller shaft axis relative to the propeller shaft, and wherein the shift shuttle is configured to move the clutch member along the propeller shaft axis to selectively engage the clutch member with the at least one gear to transfer drive from the drive shaft to the propeller shaft.

12. The marine outboard motor of claim 10, wherein the at least one gear comprises a forward gear which is engaged with the drive gear to rotate in a forward direction and a reverse gear which is engaged with the drive gear to rotate in a reverse direction.

13. The marine outboard motor of claim 12, wherein the clutch member is disposed between the forward and reverse gears and is moveable by the shift mechanism along the propeller shaft axis between a forward position, in which the clutch member is engaged with the forward gear, and a reverse position, in which the clutch member is engaged with the reverse gear.

14. The marine outboard motor of claim 1, wherein the clutch member extends around the propeller shaft.

15. The marine outboard motor of claim 1, wherein the clutch member comprises a dog ring.

16. A marine vessel comprising the marine outboard motor of claim 1.

* * * * *